US009365049B2

(12) United States Patent
Fullerton

(10) Patent No.: US 9,365,049 B2
(45) Date of Patent: Jun. 14, 2016

(54) MAGNETIZING INDUCTOR AND A METHOD FOR PRODUCING A MAGNETIZING INDUCTOR

(71) Applicant: Correlated Magnetics Research, LLC, Hunstville, AL (US)

(72) Inventor: Larry W. Fullerton, New Hope, AL (US)

(73) Assignee: Correlated Magnetics Research, LLC, Huntsville, AL (US)

( * ) Notice: Subject to any disclaimer, the term of this patent is extended or adjusted under 35 U.S.C. 154(b) by 0 days.

(21) Appl. No.: 14/869,590

(22) Filed: Sep. 29, 2015

(65) Prior Publication Data

US 2016/0031229 A1 Feb. 4, 2016

Related U.S. Application Data

(63) Continuation-in-part of application No. 14/198,400, filed on Mar. 5, 2014, which is a continuation-in-part of application No. 13/659,444, filed on Oct. 24, 2012, and a continuation-in-part of application No. 13/687,819, filed on Nov. 28, 2012, now abandoned, and a continuation-in-part of application No. 13/959,201, filed on Aug. 5, 2013, now Pat. No. 9,257,219, and a continuation-in-part of application No. 14/052,891, filed on Oct. 14, 2013, now Pat. No. 9,275,783, and a continuation-in-part of application No. 14/045,756, filed on Oct. 3, 2013, now Pat. No. 8,810,348, which is a continuation-in-part of application No. 13/240,335, filed on Sep. 22, 2011, now Pat. No. 8,648,681, which is a continuation-in-part of application No. 12/476,952, filed on Jun. 2, 2009, now Pat. No. 8,179,219, and a continuation-in-part of application No. 12/895,589, (Continued)

(51) Int. Cl.
*B41J 2/43* (2006.01)
*H01F 27/28* (2006.01)
*H01F 13/00* (2006.01)

(52) U.S. Cl.
CPC ..... *B41J 2/43* (2013.01); *H01F 13/003* (2013.01); *H01F 27/2823* (2013.01)

(58) Field of Classification Search
CPC ..... B41J 2/14; B41J 2002/041; B41J 2/16; B41J 2/43; Y10T 29/49117
See application file for complete search history.

(56) References Cited

U.S. PATENT DOCUMENTS 5,492,572 A * 2/1996 Schroeder ..... C21D 1/04 148/101
2004/0032460 A1* 2/2004 Silverbrook ..... B41J 2/14 347/54

*Primary Examiner* — Thinh Nguyen
(74) *Attorney, Agent, or Firm* — Vector IP Law Group; Robert S. Babayi

(57) ABSTRACT

An improved print head for use by a magnetic printer consists of multiple flat metal layers that form a flat metal inductor coil about a hole having a first diameter on a first side of the print head and having a second diameter smaller than the first diameter on a second side of the print head.

20 Claims, 7 Drawing Sheets

Related U.S. Application Data filed on Sep. 30, 2010, now Pat. No. 8,760,250, which is a continuation-in-part of application No. 12/885,450, filed on Sep. 18, 2010, now Pat. No. 7,982,568, and a continuation-in-part of application No. 12/476,952, filed on Jun. 2, 2009, now Pat. No. 8,179,219, said application No. 14/045,756 is a continuation-in-part of application No. 13/246,584, filed on Sep. 27, 2011, now Pat. No. 8,760,251.

(60) Provisional application No. 62/057,404, filed on Sep. 30, 2014, provisional application No. 61/851,614, filed on Mar. 11, 2013, provisional application No. 61/717,444, filed on Oct. 25, 2011, provisional application No. 61/629,806, filed on Nov. 28, 2011, provisional application No. 61/742,260, filed on Aug. 6, 2012, provisional application No. 61/795,352, filed on Oct. 15, 2012, provisional application No. 61/744,864, filed on Oct. 4, 2012, provisional application No. 61/403,814, filed on Sep. 22, 2010, provisional application No. 61/462,715, filed on Feb. 7, 2011, provisional application No. 61/277,214, filed on Sep. 22, 2009, provisional application No. 61/277,900, filed on Sep. 30, 2009, provisional application No. 61/278,767, filed on Oct. 9, 2009, provisional application No. 61/279,094, filed on Oct. 16, 2009, provisional application No. 61/281,160, filed on Nov. 13, 2009, provisional application No. 61/283,780, filed on Dec. 9, 2009, provisional application No. 61/284,385, filed on Dec. 17, 2009, provisional application No. 61/342,988, filed on Apr. 22, 2010.

(Side View)

(Side View)

(Side View)

MAGNETIZING INDUCTOR AND A METHOD FOR PRODUCING A MAGNETIZING INDUCTOR

This non-provisional patent application is continuation-in-part of non-provisional application Ser. No. 14/198,400, filed Mar. 5, 2014, which is a continuation in part of non-provisional application Ser. No. 13/659,444, filed Oct. 24, 2012, titled "A System and Method for Producing Magnetic Structures" by Fullerton et al. and claims the benefit under 35 USC 119(e) of provisional application 61/851,614, titled "A System and Method for Producing Magnetic Structures", filed Mar. 11, 2013, by Fullerton et al.; Ser. No. 13/659,444 claims the benefit under 35 USC 119(e) of provisional application 61/717,444, titled "A System and Method for Producing Magnetic Structures", filed Oct. 25, 2011 by Fullerton et al.

Non-provisional application Ser. No. 14/198,400 is also a continuation in part of non-provisional application Ser. No. 13/687,819, filed Nov. 28, 2012, titled "System and Method for Focusing Magnetic Fields" by Loum et al, which claims the benefit under 35 USC 119(e) of provisional application 61/629,806, titled "System and Method for Focusing Magnetic Fields", filed Nov. 28, 2011, by Loum et al.

Non-provisional application Ser. No. 14/198,400 is also a continuation in part of non-provisional application Ser. No. 13/959,201, filed Aug. 5, 2013, titled "System and Method for Magnetization" by Fullerton et al, which claims the benefit under 35 USC 119(e) of provisional application 61/742,260, titled "System and Method for Focusing Magnetic Fields", filed Aug. 6, 2012, by Fullerton et al.

Non-provisional application Ser. No. 14/198,400 is also a continuation in part of non-provisional application Ser. No. 14/052,891, filed Oct. 14, 2013, titled "System and Method for Demagnetization of a Magnetic Structure Region" by Fullerton et al, which claims the benefit under 35 USC 119(e) of provisional application 61/795,352, titled "System and Method for Demagnetization of a Magnetic Structure Region", filed Oct. 15, 2012, by Fullerton et al.

Non-provisional application Ser. No. 14/198,400 is also a continuation in part of U.S. non-provisional Pat. No. 8,810,348, issued Aug. 19, 2014, titled "System And Method For Tailoring Polarity Transitions of Magnetic Structures" by Fullerton et al. which claims the benefit under 35 USC 119(e) of U.S. Provisional Patent Application No. 61/744,864, titled "System And Method For Tailoring Polarity Transitions of Magnetic Structures", filed Oct. 4, 2012, by Fullerton et al; U.S. Pat. No. 8,810,348 is a continuation-in-part of U.S. Pat. No. 8,648,681, issued Feb. 11, 2014, titled "Magnetic Structure Production", which claims the benefit of U.S. provisional patent application No. 61/403,814, filed Sep. 22, 2010, titled "System and Method for Producing Magnetic Structures" and U.S. provisional patent application No. 61/462,715, filed Feb. 7, 2011, titled "System and Method for Producing Magnetic Structures"; U.S. Pat. No. 8,648,681 is a continuation-in-part of U.S. Pat. No. 8,179,219, issued May 15, 2012, titled "Field Emission System And Method"; 8,648,681 is also a continuation-in-part of U.S. Pat. No. 8,760,250, issued Jun. 24, 2014, which is entitled "A System And Method For Energy Generation", which claims the benefit of provisional patent application Nos. 61/277,214, filed Sep. 22, 2009, 61/277,900 filed Sep. 30, 2009, 61/278,767, filed Oct. 9, 2009, 61/279,094, filed Oct. 16, 2009, 61/281,160, filed Nov. 13, 2009, 61/283,780, filed Dec. 9, 2009, 61/284,385, filed Dec. 17, 2009, and 61/342,988, filed Apr. 22, 2010; U.S. Pat. No. 8,760,250 is a continuation-in-part of U.S. Pat. Nos. 7,982,568, issued Jul. 19, 2011, and 8,179,219, issued May 15, 2012; U.S. Pat. No. 8,810,348 is also a continuation-in-part of U.S. Pat. No. 8,760,251, issued Jun. 24, 2014, which is entitled "System and Method for Producing Stacked Field Emission Structures". The contents of the provisional patent applications, the contents of the non-provisional patent applications, and the contents of the issued patents that are identified above are hereby incorporated by reference in their entirety herein.

FIELD OF THE INVENTION

The present invention relates generally to a magnetizing inductor and a method for producing a magnetizing inductor. More particularly, the present invention relates to a magnetizing inductor consisting of a stack of a plurality of flat conductor layers that form a plurality of turns about a hole tapered such that a first diameter of the hole on a first side of the magnetizing inductor is greater than a second diameter of the hole on a second side of the magnetizing inductor that is opposite the first side.

BACKGROUND OF THE INVENTION

The present invention is enabled by a magnetizer that functions as a magnetic printer that is able to move a magnetizable material relative to the location of a print head (and/or vice versa) so that magnetic pixels (or maxels) can be printed in a prescribed pattern at locations on the magnetizable material. Generally, the print head of the magnetic printer consists of multiple flat metal layers that form a flat metal inductor coil about a hole, where the shape of the print head may or may not conform to different shaped surfaces.

FIG. 1A provides an oblique projection view and FIGS. 1B and 1C provide side views of a prior art print head 100 having a flat print surface (i.e., the surface that would typically come into contact with the surface of a magnetizable material). Specifically, the print head 100 of FIGS. 1A-1C comprises a multiple turn flat metal (e.g., copper) coil 102 having tabs 106 for connecting to wiring of a magnetization subsystem. The multiple turn flat metal coil 102 includes a cylindrically shaped hole (or aperture) 104 in which a magnetic field is produced to print a maxel into the magnetizable material, where the magnetizable material may have a flat surface 108 substantially parallel to the flat print surface of the print head 100 such as depicted in FIG. 1B. Alternatively, the print head 100 can be brought into contact and print a maxel onto magnetizable material having a convex surface 110 such as depicted in FIG. 1C.

FIG. 1D depicts an alternative prior art print head shape where the various flat metal layers of the print head have a concave shape that conforms to a convex surface 110 of a magnetizable material and where the print head 100 has a cylindrically shaped hole.

FIGS. 1E-1G depict another alternative prior art print head shape where the various flat metal layers of the print head 100 have a convex shape enabling the print head to come into contact with a convex shaped surface of a magnetizable material such as in FIG. 1E but also flat and concave shaped surfaces of magnetizable material such as shown in FIGS. 1F and 1G, respectively, where the print head 100 has a cylindrically shaped hole. FIG. 1H depicts yet another alternative prior art print head shape where the various flat metal layers of the print head 100 have a funnel-like shape and the print head 100 has a cylindrically shaped hole.

FIG. 1I depicts an example design of multiple layers 108*a*-108*c* of a prior art magnetic print head 100, where each of the multiple layers 108*a*-108*c* of the print head have a hole 104*a*-104*c* having the same diameter such that when the print head 100 is constructed, e.g., by welding the multiple layers together, it will have a cylindrically shaped hole. Referring to FIG. 1I, the print head 100 includes a bottom layer 108*a* that has a slot 114*a* and a hole 104*a* having a first diameter, a middle layer 108*b* that has a slot 114*b* and a hole also having the first diameter, and a top layer 108*c* has a slot 114*c* and a hole 104*c* also having the first diameter.

SUMMARY OF THE INVENTION

In accordance with one aspect of the invention, a print head for magnetically printing a magnetic source into a magnetizable material includes a first conductor layer on a first side of a print head and a second conductor layer on a second side of the print head that is opposite the first side. The first conductor layer and the second conductor layer form a flat metal inductor coil about a hole having a first diameter on the first side of the print head and a second diameter on the second side of the print head, where the second diameter is smaller than the first diameter.

The shape of the print head can conform to different shaped surfaces.

The first conductor layer can have a first thickness and the second conductor layer can have a second thickness less than the first thickness.

The first thickness and second thickness can be proportional to the first diameter and the second diameter.

The hole can be a conically-shaped hole.

The hole can be a step-shaped hole.

The print head can also include at least one additional conductor layer between the first conductor layer and the second conductor layer. Each conductor layer of the first conductor layer, the second conductor layer, and the at least one additional conductor layer can have a funnel-like shape. The hole can have a third diameter corresponding to the at least one additional conductor layer, where the third diameter is smaller than the first diameter and larger than the second diameter. Each conductor layer of the first conductor layer, the second conductor layer, and the at least one additional conductor layer can have a different thickness, where a thickness of each conductor layer of the first conductor layer, the second conductor layer, and the at least one additional conductor layer can be proportional to the diameter of the hole corresponding to each conductor layer.

The first conductor layer and the second conductor layer can each comprise a metal.

The metal may include copper.

The flat metal inductor coil can have a concave shape.

The flat metal inductor coil can have a concave shape.

The print head can include four conductor layers.

The print head can include six conductor layers.

The first conductor layer and the second conductor layer each have a funnel-like shape.

The print head can include a first tab for connecting the first conductor layer to wiring of a magnetization subsystem.

The print head can include a second tab for connecting the second conductor layer to wiring of a magnetization subsystem.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

Figure 1A:
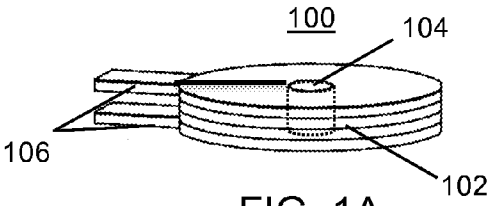
FIG. 1A (Prior Art)
FIG. 1A depicts an oblique projection view of an exemplary prior art print head having a flat print surface and a cylindrically shaped hole.
Figure 1B:
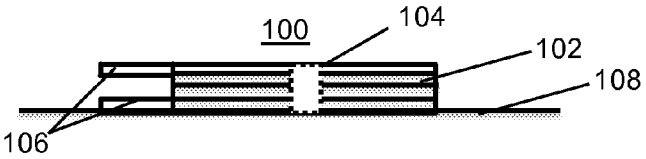
FIG. 1B (Prior Art)
FIGS. 1B and 1C depict side views of the print head of FIG. 1A printing on a magnetizable material having a flat surface and a convex surface, respectively.
Figure 1C:
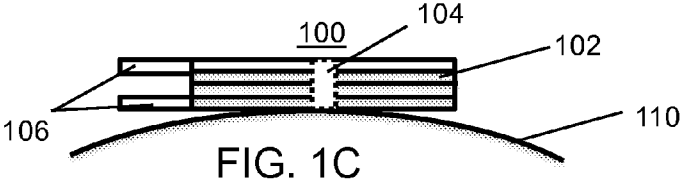
FIG. 1C (Prior Art)
Figure 1D:
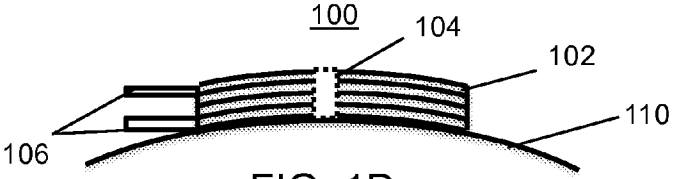
FIG. 1D (Prior Art)
FIG. 1D depicts an alternative prior art print head shape where the various flat metal layers of the print head have a concave shape that conforms to a convex surface of a magnetizable material and where the hole of the print head is cylindrically shaped.
Figure 1E:
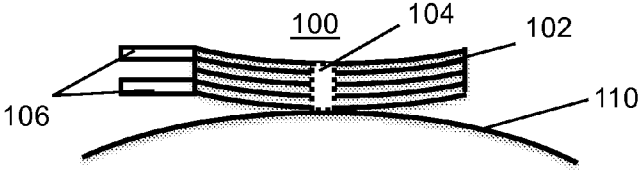
FIG. 1E (Prior Art)
FIGS. 1E-1G depict another alternative prior art print head shape where the various flat metal layers of the print head have a convex shape enabling the print head to come into contact with a magnetizable material having a convex shaped surface, flat surface, or a concave shaped surface and where the hole of the print head is cylindrically shaped.
Figure 1F:
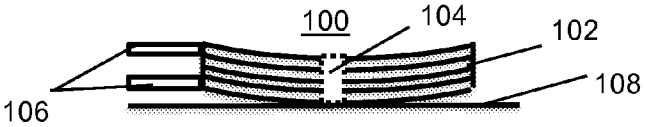
FIG. 1F (Prior Art)
Figure 1G:
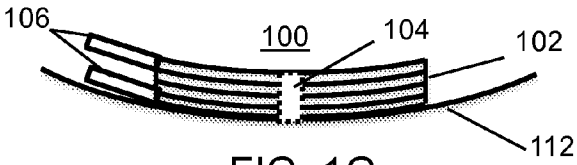
FIG. 1G (Prior Art)
Figure 1H:
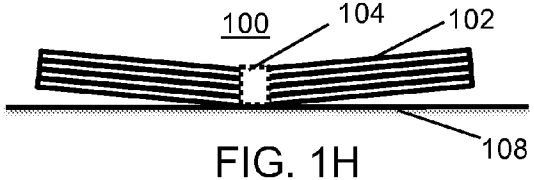
FIG. 1H (Prior Art)
FIG. 1H depicts yet another alternative prior art print head shape where the various flat metal layers of the print head have a funnel-like shape and where the hole of the print head is cylindrically shaped.

The present invention will now be described more fully in detail with reference to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in the art.

Certain described embodiments may relate, by way of example but not limitation, to systems and/or apparatuses comprising magnetic structures, magnetic and non-magnetic materials, methods for using magnetic structures, magnetic structures produced via magnetic printing, magnetic structures comprising arrays of discrete magnetic elements, combinations thereof, and so forth. Example realizations for such embodiments may be facilitated, at least in part, by the use of an emerging, revolutionary technology that may be termed correlated magnetics. This revolutionary technology referred to herein as correlated magnetics was first fully described and enabled in the co-assigned U.S. Pat. No. 7,800,471 issued on Sep. 21, 2010, and entitled "A Field Emission System and Method". The contents of this document are hereby incorporated herein by reference. A second generation of a correlated magnetic technology is described and enabled in the co-assigned U.S. Pat. No. 7,868,721 issued on Jan. 11, 2011, and entitled "A Field Emission System and Method". The contents of this document are hereby incorporated herein by reference. A third generation of a correlated magnetic technology is described and enabled in the co-assigned U.S. Pat. No. 8,179,219, issued May 15, 2012, and entitled "A Field Emission System and Method". The contents of this document are hereby incorporated herein by reference. Another technology known as correlated inductance, which is related to correlated magnetics, has been described and enabled in the co-assigned U.S. Pat. No. 8,115,581 issued on Feb. 14, 2012, and entitled "A System and Method for Producing an Electric Pulse". The contents of this document are hereby incorporated by reference.

Material presented herein may relate to and/or be implemented in conjunction with multilevel correlated magnetic systems and methods for producing a multilevel correlated magnetic system such as described in U.S. Pat. No. 7,982,568 issued Jul. 19, 2011 which is all incorporated herein by reference in its entirety. Material presented herein may relate to and/or be implemented in conjunction with energy generation systems and methods such as described in U.S. Pat. No. 8,222,986 issued Jul. 17, 2012, which is all incorporated herein by reference in its entirety. Such systems and methods described in U.S. Pat. Nos. 7,681,256 issued Mar. 23, 2010, 7,750,781 issued Jul. 6, 2010, 7,755,462 issued Jul. 13, 2010, 7,812,698 issued Oct. 12, 2010, 7,817,002, 7,817,003, 7,817,004, 7,817,005, and 7,817,006 issued Oct. 19, 2010, 7,821,367 issued Oct. 26, 2010, 7,823,300 and 7,824,083 issued Nov. 2, 2011, 7,834,729 issued Nov. 16, 2011, 7,839,247 issued Nov. 23, 2010, 7,843,295, 7,843,296, and 7,843,297 issued Nov. 30, 2010, 7,893,803 issued Feb. 22, 2011, 7,956,711 and 7,956,712 issued Jun. 7, 2011, 7,958,575, 7,961,068 and 7,961,069 issued Jun. 14, 2011, 7,963,818 issued Jun. 21, 2011, and 8,015,752 and 8,016,330 issued Sep. 13, 2011, 8,035,260 issued Oct. 11, 2011, 8,098,122 issued Jan. 17, 2012, 8,279,031 issued Oct. 2, 2012, 8,356,400 issued Jan. 22, 2013, 8,368,495 issued Feb. 5, 2013, 8,514,046 issued Aug. 20, 2013, 8,576,036 issued Nov. 5, 2013, 8,638,016 issued Jan. 28, 2014, 8,648,681 issued Feb. 11, 2014, 8,692,637 issued Apr. 8, 2014, 8,702,437 and 8,704,626 issued Apr. 22, 2014, 8,760,251 issued Jun. 24, 2014, 8,779,879 issued Jul. 15, 2014, and 8,810,348 issued Aug. 19, 2014 are all incorporated by reference herein in their entirety.

Material presented herein may relate to and/or be implemented in conjunction with systems and methods described in U.S. patent application Ser. No. 13/779,611, filed Feb. 27, 2013 titled "System for Detaching a Magnetic Structure from a Ferromagnetic Material", which is incorporated herein by reference. Material may also relate to systems and methods described in U.S. patent application titled "System for Controlling Magnetic Flux of a Multi-pole Magnetic Structure, filed Nov. 5, 2013, which is incorporated herein by reference. Material may also relate to systems and methods described in U.S. Pat. No. 8,937,521 titled "System for Concentrating Magnetic Flux of a Multi-pole Magnetic Structure, issued Jan. 20, 2015, which is incorporated herein by reference.

The present invention pertains to producing magnetic structures by magnetically printing magnetic pixels (or maxels) onto magnetizable material, which can be described as magnetizing spots or spot magnetization. It is enabled by a magnetizer that functions as a magnetic printer that is able to move a magnetizable material relative to the location of a magnetic print head (and/or vice versa) so that magnetic pixels (or maxels) can be printed onto (and into) the magnetizable material in a prescribed pattern. When the magnetizer is printing maxels, the print head is adjacent to the magnetizable material, where the maxel is printed (or magnetized) by the magnetic field emerging from the aperture of the print head instead of the magnetic field inside the aperture (i.e., hole) of the print head. Typically, the magnetizable material being spot magnetized is much greater in size than the size of the aperture of the print head and therefore the magnetizable material is unable to fit inside the hole of the print head (i.e., the print head, an inductor coil, doesn't surround the material being magnetized as do coils of most conventional magnetizers).

Characteristics of the print head can be established to produce a specific shape and size of maxel given a prescribed magnetization voltage and corresponding current for a given magnetizable material where characteristics of the magnetizable material can be taken into account as part of the printing process. The printer can be configured to magnetize in a direction perpendicular to a magnetization surface, but the printer can also be configured to magnetize in a direction non-perpendicular to a magnetization surface.

A magnetic printer having a print head, which is also referred to as an inductor coil, is described in U.S. Pat. No. 8,179,219, issued May 15, 2012, titled "A Field Emission System and Method", which is incorporated herein by reference. An alternative print head design is described in U.S. Pat. No. 8,760,250, issued Jun. 24, 2014, titled "System and Method for Energy Generation", which is incorporated herein by reference. Another alternative print head design is described in relation to FIGS. 19A through 19P of U.S. Pat. No. 8,648,681, Feb. 11, 2014, titled "Magnetic Structure Production", which is incorporated herein by reference.

As previously mentioned above, the present invention is enabled by a magnetizer that functions as a magnetic printer that is able to move a magnetizable material relative to the location of a print head (and/or vice versa) so that magnetic pixels (or maxels) can be printed in a prescribed pattern at locations on the magnetizable material.

Generally, the present invention involves a print head for use by a magnetic printer that consists of multiple flat metal layers that form a flat metal inductor coil about a hole having a first diameter on a first side of the print head and having a second diameter smaller than the first diameter on a second side of the print head that is opposite the first side, where the shape of the print head may or may not conform to different shaped surfaces.

Figure 2A:
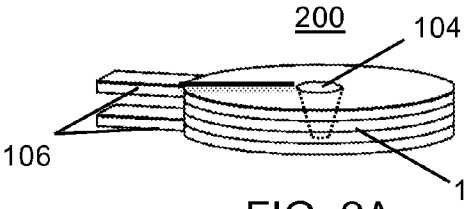
FIG. 2A depicts an oblique projection view of an exemplary print head having a flat print surface and a conically shaped hole.
Figure 2B:
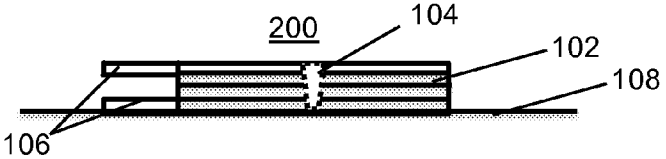
FIGS. 2B and 2C depict side views of the print head of FIG. 1A printing on a magnetizable material having a flat surface and a convex surface, respectively.
Figure 2C:
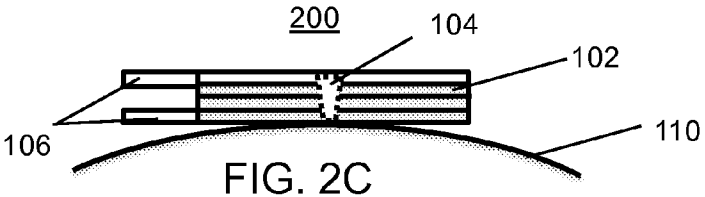

FIG. 2A provides an oblique projection view and FIGS. 2B and 2C provide side views of an exemplary print head 200 having a flat print surface (i.e., the surface that would typically come into contact with the surface of a magnetizable material). Specifically, the print head 200 of FIGS. 2A-2C comprises a multiple turn flat metal (e.g., copper) coil 102 having tabs 106 for connecting to wiring of a magnetization subsystem. The multiple turn flat metal coil 102 includes a conically-shaped hole (or aperture) 104 in which a magnetic field is produced to print a maxel into the magnetizable material, where the magnetizable material may have a flat surface 108 substantially parallel to the flat print surface of the print head 200 such as depicted in FIG. 2B. Alternatively, the print head 200 can be brought into contact and print a maxel onto magnetizable material having a convex surface 110 such as depicted in FIG. 2C.

Figure 2D:
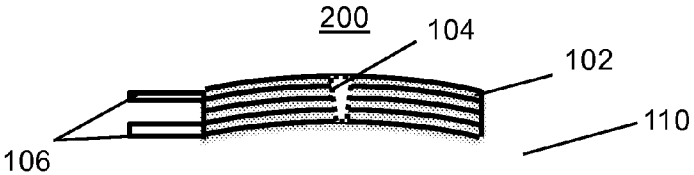
FIG. 2D depicts an alternative print head shape where the various flat metal layers of the print head have a concave shape that conforms to a convex surface of a magnetizable material and where the hole of the print head is conically shaped.

FIG. 2D depicts an alternative exemplary print head shape where the various flat metal layers of the print head have a concave shape that conforms to a convex surface 110 of a magnetizable material and where the print head 200 has a conically shaped hole.

Figure 2E:
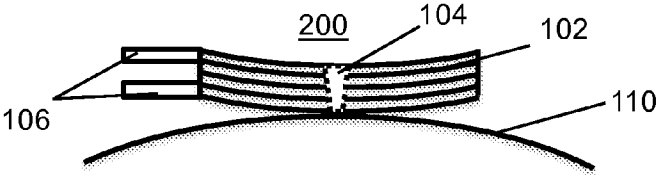
FIGS. 2E-2G depict another alternative print head shape where the various flat metal layers of the print head have a convex shape enabling the print head to come into contact with a magnetizable material having a convex shaped surface, flat surface, or a concave shaped surface and where the hole of the print head is conically shaped.
Figure 2F:
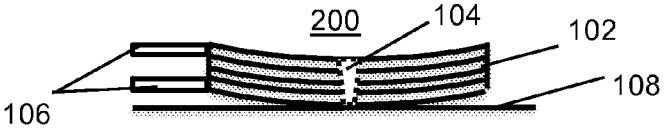
Figure 2G:
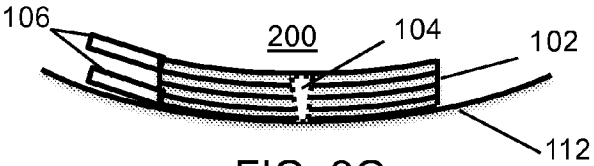

FIGS. 2E-2G depict another alternative exemplary print head shape where the various flat metal layers of the print head 200 have a convex shape enabling the print head to come into contact with a convex shaped surface of a magnetizable material such as in FIG. 2E but also flat and concave shaped surfaces of magnetizable material such as shown in FIGS. 2F and 2G, respectively, where the print head 200 has a conically shaped hole.

Figure 2H:
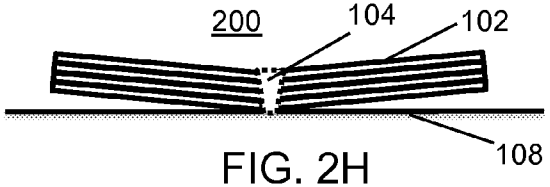
FIG. 2H depicts yet another alternative print head shape where the various flat metal layers of the print head have a funnel-like shape and where the hole of the print head is conically shaped.

FIG. 2H depicts yet another alternative print head shape where the various flat metal layers of the print head 200 have a funnel-like shape and the print head 200 has a conically shaped hole.

Figure 1I:
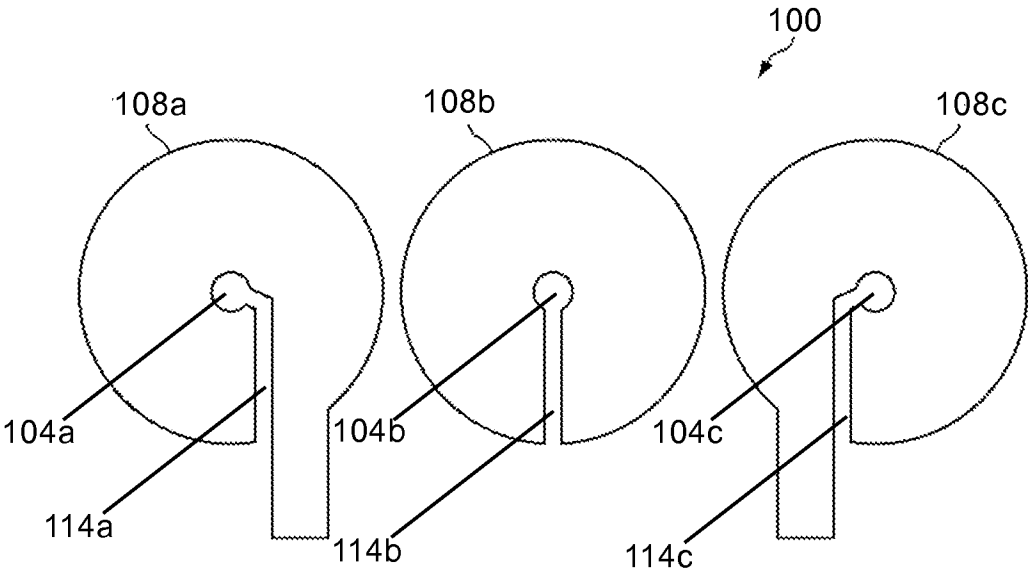
FIG. 1I (Prior Art)
FIG. 1I depicts an example design of multiple layers of a prior art magnetic print head, where each of the multiple layers of the print head has a hole having the same diameter such that when the print head is assembled it will have a cylindrically shaped hole.
Figure 2I:
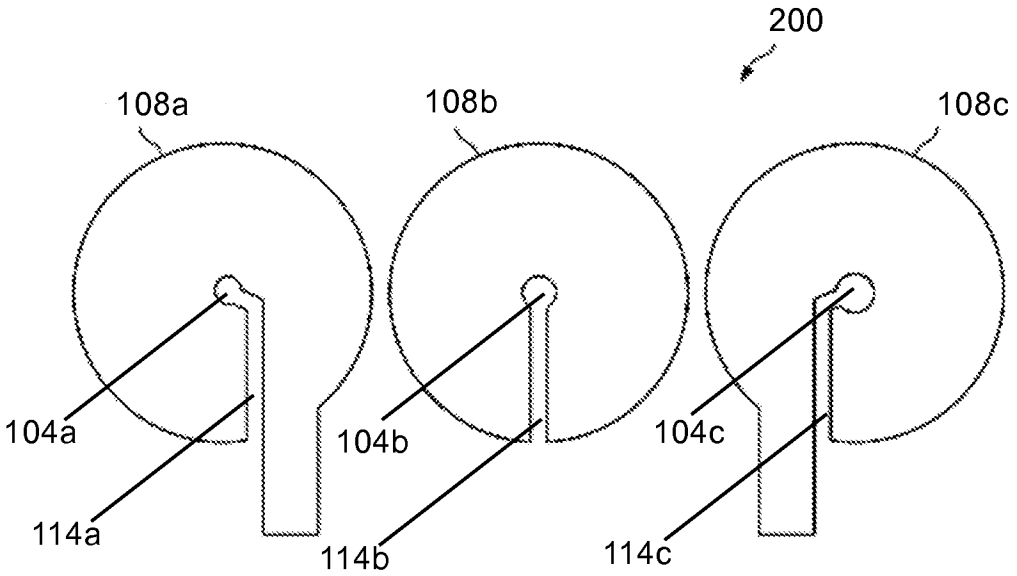
FIG. 2I depicts an example design of multiple layers of a magnetic print head, where each of the multiple layers of the print head have holes with different diameters such that when the print head is assembled it will have a conically shaped hole.

FIG. 2I depicts an example design of multiple layers 108*a*-108*c* of a magnetic print head 100, where each of the multiple layers 108*a*-108*c* of the print head have hole 104*a*-104*c* having the same diameter such that when the print head 100 is constructed, e.g., by welding the multiple layers together, it will have a cylindrically shaped hole. Referring to FIG. 1I, the print head includes a bottom layer 108*a* that has a slot 114*a* and a hole 104*a* having a first diameter, a middle layer 108*b* that has a slot 114*b* and a hole also having a second diameter greater than the first diameter, and a top layer 108*c* has a slot 114*c* and a hole 104*c* having a third diameter greater than the first diameter and the second diameter.

Figure 3A:
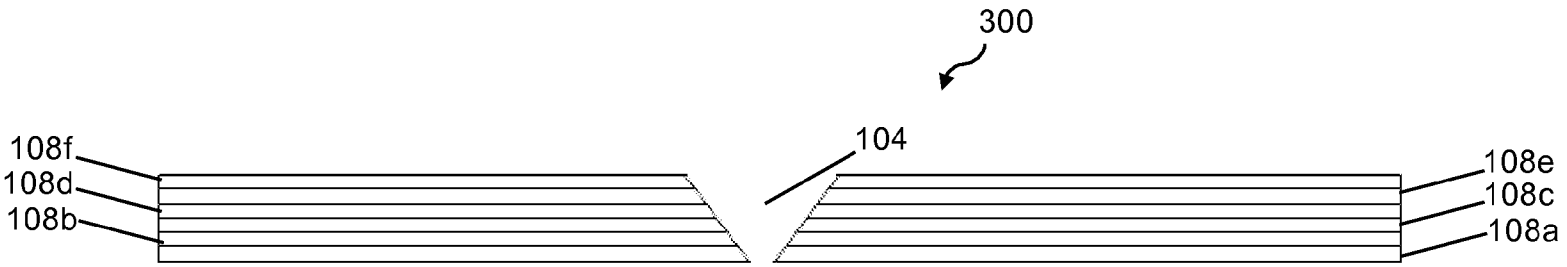
FIG. 3A depicts a side view of a cross section of an exemplary print head having six flat metal layers where the print head has a conically shaped hole.

FIG. 3A depicts a side view of a cross section of an exemplary print head 300 having six flat metal layers 108*a*-108*f*, where the print head 300 has a conically shaped hole 104.

Figure 3B:
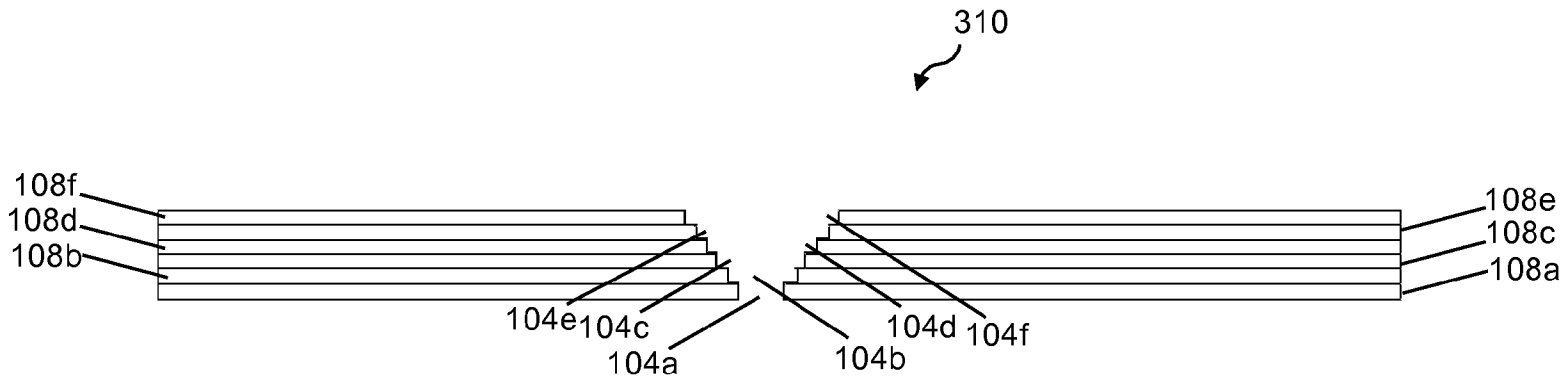
FIG. 3B depicts a side view of a cross section of an exemplary print head having six flat metal layers where the print head has a step-shaped hole.

FIG. 3B depicts a side view of a cross section of an exemplary print head 310 having six flat metal layers 108*a*-108*f*, where the print head 310 has a step-shaped hole corresponding to the six holes 104*a*-104*f* of the six flat metal layers 108*a*-108*f*.

Figure 3C:
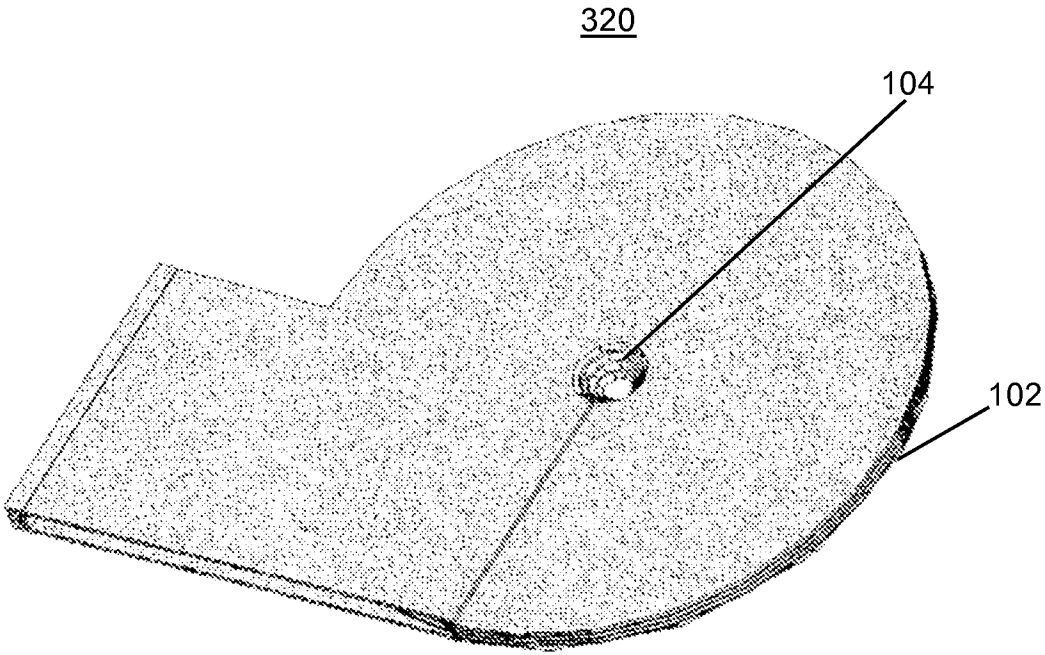
FIG. 3C depicts an oblique view of an exemplary print head having four flat metal layers where the print head has a step-shaped hole.
Figure 4:
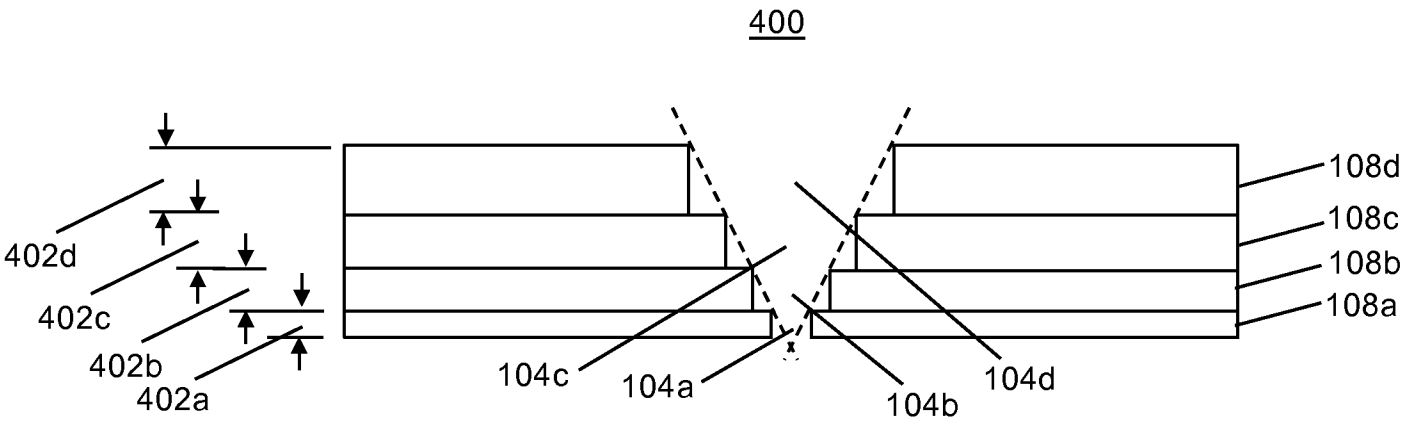
FIG. 4 depicts a side view of a cross section of an exemplary print head having four flat metal layers where the hole of the print head has a step-shaped hole and where the layers increase in thickness proportionally to the diameter of the hole of a given layer.

FIG. 3C depicts an oblique view of an exemplary print head 320 having four flat metal layers where the print head 320 has a step-shaped hole 104; and FIG. 4 depicts a side view of a cross section of an exemplary print head 400 having four flat metal layers 108*a*-180*d*, where the print head 400 has a step-shaped hole and where the four thicknesses 402*a*-402*d* of the four flat metal layers 108*a*-180*d* increases proportionally with the four diameters of the four hole 104*a*-104*d* of the four flat metal layers 108*a*-180*d*.

While particular embodiments of the invention have been described, it will be understood, however, that the invention is not limited thereto, since modifications may be made by those skilled in the art, particularly in light of the foregoing teachings.

The invention claimed is:

1. A print head for magnetically printing a magnetic source into a magnetizable material comprising:

a first conductor layer on a first side of a print head; and a second conductor layer on a second side of said print head that is opposite said first side, said first conductor layer and said second conductor layer forming a flat metal inductor coil about a hole, said hole having a first diameter on said first side of said print head and having a second diameter on said second side of said print head, said second diameter being smaller than said first diameter.

2. The print head of claim 1, wherein the shape of the print head conforms to different shaped surfaces.

3. The print head of claim 1, wherein said first conductor layer has a first thickness and said second conductor layer has a second thickness less than said first thickness.

4. The print head of claim 3, wherein said first thickness and second thickness are proportional to said first diameter and said second diameter.

5. The print head of claim 1, wherein said hole is a conically-shaped hole.

6. The print head of claim 1, wherein said hole is a step-shaped hole.

7. The print head of claim 1, further comprising:

at least one additional conductor layer between said first conductor layer and said second conductor layer.

8. The print head of claim 7, wherein each conductor layer of said first conductor layer, said second conductor layer, and said at least one additional conductor layer has a funnel-like shape.

9. The print head of claim 7, wherein said hole has a third diameter corresponding to said at least one additional conductor layer, said third diameter being smaller than said first diameter and larger than said second diameter.

10. The print head of claim 9, wherein a thickness of each conductor layer of said first conductor layer, said second conductor layer, and said at least one additional conductor layer is proportional to the diameter of said hole corresponding to each conductor layer.

11. The print head of claim 7, wherein each conductor layer of said first conductor layer, said second conductor layer, and said at least one additional conductor layer has a different thickness.

12. The print head of claim 1, wherein said first conductor layer and said second conductor layer each comprise a metal.

13. The print head of claim 12, wherein said metal comprises copper.

14. The print head of claim 1, wherein said flat metal inductor coil has a concave shape.

15. The print head of claim 1, wherein said flat metal inductor coil has a concave shape.

16. The print head of claim 1, wherein said print head comprises four conductor layers.

17. The print head of claim 1, wherein said print head comprises six conductor layers.

18. The print head of claim 1, wherein said first conductor layer and said second conductor layer each have a funnel-like shape.

19. The print head of claim 1, further comprising:

a first tab for connecting said first conductor layer to wiring of a magnetization subsystem.

20. The print head of claim 1, further comprising:

a second tab for connecting said second conductor layer to wiring of a magnetization subsystem.

* * * * *